US008347962B2

(12) United States Patent
Sampson et al.

(10) Patent No.: US 8,347,962 B2
(45) Date of Patent: Jan. 8, 2013

(54) NON FRANGIBLE PERFORATING GUN SYSTEM

(75) Inventors: Timothy Sampson, Spring, TX (US); Anna Schwartz, Raanana (IL); Mark Sloan, Bellville, TX (US); Avigdor Hetz, Houston, TX (US); Jason McCann, Cypress, TX (US); Meir Mayseless, Haifa (IS)

(73) Assignee: Baker Hughes Incorporated, Houston, TX (US)

( * ) Notice: Subject to any disclaimer, the term of this patent is extended or adjusted under 35 U.S.C. 154(b) by 135 days.

(21) Appl. No.: 11/485,908

(22) Filed: Jul. 13, 2006

(65) Prior Publication Data

US 2012/0168162 A1 Jul. 5, 2012

Related U.S. Application Data

(60) Provisional application No. 60/730,624, filed on Oct. 27, 2005.

(51) Int. Cl.
*E21B 43/11* (2006.01)

(52) U.S. Cl. ..... 166/297; 166/55; 102/312

(58) Field of Classification Search ..... 175/4.6, 175/4.51; 166/297, 55; 102/312
See application file for complete search history.

(56) References Cited

U.S. PATENT DOCUMENTS

| | | | | |
|---|---|---|---|---|
| 2,782,715 | A | 2/1957 | Udry | |
| 3,100,445 | A | 8/1963 | Poulter | |
| 3,773,119 | A * | 11/1973 | Shore | 175/4.6 |
| 4,140,188 | A * | 2/1979 | Vann | 175/4.51 |
| 4,794,990 | A | 1/1989 | Riggs | |
| 4,817,531 | A | 4/1989 | Walker et al. | |
| 5,662,178 | A | 9/1997 | Shirley et al. | |
| 5,775,426 | A * | 7/1998 | Snider et al. | 166/308.1 |
| 5,841,060 | A | 11/1998 | Skaggs | |
| 6,216,596 | B1 | 4/2001 | Wesson | |
| 6,520,258 | B1 * | 2/2003 | Yang et al. | 166/297 |
| 6,523,474 | B2 | 2/2003 | Parrott et al. | |
| 6,591,911 | B1 * | 7/2003 | Markel et al. | 166/297 |
| 6,837,310 | B2 * | 1/2005 | Martin | 166/297 |
| 7,114,564 | B2 * | 10/2006 | Parrott et al. | 166/255.2 |
| 7,195,066 | B2 * | 3/2007 | Sukup et al. | 166/298 |
| 7,360,599 | B2 * | 4/2008 | Walker et al. | 166/297 |
| 2002/0189482 | A1 | 12/2002 | Kneisl et al. | |
| 2004/0211565 | A1 | 10/2004 | Kash | |
| 2005/0092493 | A1 * | 5/2005 | Sukup et al. | 166/298 |
| 2005/0173118 | A1 | 8/2005 | Li et al. | |
| 2005/0235859 | A1 * | 10/2005 | Myers et al. | 102/307 |
| 2006/0108148 | A1 | 5/2006 | Walker et al. | |
| 2010/0276144 | A1 * | 11/2010 | Hetz et al. | 166/297 |

FOREIGN PATENT DOCUMENTS

| | | | |
|---|---|---|---|
| FR | 2792717 | A1 | 10/2000 |
| GB | 2308177 | A | 6/1997 |
| GB | 2390623 | A | 1/2004 |
| GB | 2394762 | A | 5/2005 |
| GB | 2410785 | | 8/2005 |
| GB | 2410785 | A | 10/2005 |

* cited by examiner

OTHER PUBLICATIONS

Canadian Office Action dated Sep. 8, 2008, 2 pages.

*Primary Examiner* — Jennifer H Gay
*Assistant Examiner* — Elizabeth Gitlin
(74) *Attorney, Agent, or Firm* — Bracewell & Giuliani LLP

(57) ABSTRACT

A shaped charge assembly for use in a perforating gun that further comprises a charge carrier, and gun housing. The charge carrier substantially encapsulates the closed portion of the shaped charge and extends from the outer periphery of the shaped charge to the inner diameter of the associated gun housing. Encapsulating the shaped charge substantially reduces the introduction of debris into the wellbore resulting from detonation of the perforating gun shaped charges. The charge carrier can include a multiplicity of shaped charges therein.

20 Claims, 4 Drawing Sheets

NON FRANGIBLE PERFORATING GUN SYSTEM

RELATED APPLICATIONS

This application claims priority from co-pending U.S. Provisional Application No. 60/730,624, filed Oct. 27, 2005, the full disclosure of which is hereby incorporated by reference herein.

BACKGROUND OF THE INVENTION

1. Field of the Invention

The invention relates generally to the field of oil and gas production. More specifically, the present invention relates to a non-frangible shaped charge system. Yet more specifically, the present invention relates to a perforating gun system that after detonation of its associated shaped charges minimizes wellbore gun fragments produced during well perforations.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. Included with the perforating guns are shaped charges that typically include a housing, a liner, and a quantity of high explosive inserted between the liner and the housing. When the high explosive is detonated, the force of the detonation collapses the liner and ejects it from one end of the charge at very high velocity in a pattern called a "jet". The jet penetrates the casing, the cement and a quantity of the formation.

Due to the high force caused by the explosive, the shaped charge and its associated components often shatter into many fragments that exit the perforating gun into the fluids within the wellbore. These fragments can clog as well as damage devices such as chokes and manifolds thereby restricting the flow of fluids through these devices and possibly hampering the amount of hydrocarbons produced from the particular wellbore. Therefore, there exists a need for an apparatus and a method for conducting perforating operations that can significantly reduce fragmentation of shaped charges.

BRIEF SUMMARY OF THE INVENTION

The present invention involves a shaped charge assembly comprising, a gun housing, a shaped charge housed within the gun housing, and a charge carrier disposed in the space between the gun housing and the shaped charge. The charge carrier fills at least a portion of the volume between the outer periphery of the shaped charge and the gun housing. The combined volume of the charge carrier and the shaped charge can range from about 20% to about 80% of the total empty volume of the gun housing inner space; the free volume within the gun housing can range from about 80% to about 20% of the total empty volume of the gun housing inner space. Optionally, the combined volume of the charge carrier and the shaped charge can be about 65% of the total empty volume of the gun housing inner space. In the optional embodiment, the free volume within the gun housing can be about 35% of the total empty volume of the gun housing inner space.

In one embodiment of the present device, the shaped charge has an open end, and the shaped charge assembly further comprise a gap in the region between the open end of the shaped charge and the gun housing. An explosive can be disposed within the shaped charge, wherein the charge carrier maintains the structural integrity of the shaped charge upon detonation of the explosive. Moreover, the shaped charge assembly can further comprise a multiplicity of shaped charges. A multiplicity of bores may be disposed on the charge carrier formed to receive the multiplicity of shaped charges. The bores may be arranged perpendicular to the axis of the charge carrier and disposed at substantially the same radial location about the axis of the charge carrier. In another embodiment, each bore may be arranged perpendicular to the axis of the charge carrier and spaced about the axis of the charge carrier at multiple radial locations. Also, the bores may form a spiral pattern along the outer surface of the charge carrier.

Each shaped charges may have an open end and wherein each shaped charge assembly may further comprise a gap in the region between each of the open ends and the gun housing. An explosive may be further included within each shaped charge, wherein the charge carrier maintains the structural integrity of each shaped charge upon detonation of the explosives.

An orienting weight can optionally be included with the charge carrier. Also, the charge carrier may comprise at least two modular segments. The modular segments may be configured in a phased arrangement. In one alternative embodiment of the shaped charge assembly, the charge carrier may be comprised of interconnected strands.

Also included with the present disclosure is a shaped charge assembly comprising, a gun housing, a shaped charge housed within the gun housing where the shaped charge includes a casing, a liner within the casing, and explosive between the casing and the liner. This embodiment of a shaped charge assembly includes a charge carrier disposed in the space between the gun housing and the shaped charge, wherein the charge carrier circumscribes the outer surface of the casing and minimizes fragmentation during detonation of the explosive. Here the combined volume of the charge carrier and the shaped charge can range from about 20% to about 80% of the total empty volume of the gun housing inner space and the free volume within the gun housing may range from about 80% to about 20% of the total empty volume of the gun housing inner space. Optionally in this embodiment, the combined volume of the charge carrier and the shaped charge may be about 65% of the total empty volume of the gun housing inner space and the free volume within the gun housing can be about 35% of the total empty volume of the gun housing inner space. The shaped charges of this embodiment can be a phased arrangement, further the shaped charge assembly may additionally comprise an orienting weight.

The charge carrier may optionally comprise at least two modular segments and can also be comprised of interconnected strands.

DETAILED DESCRIPTION OF THE INVENTION

Figure 1:
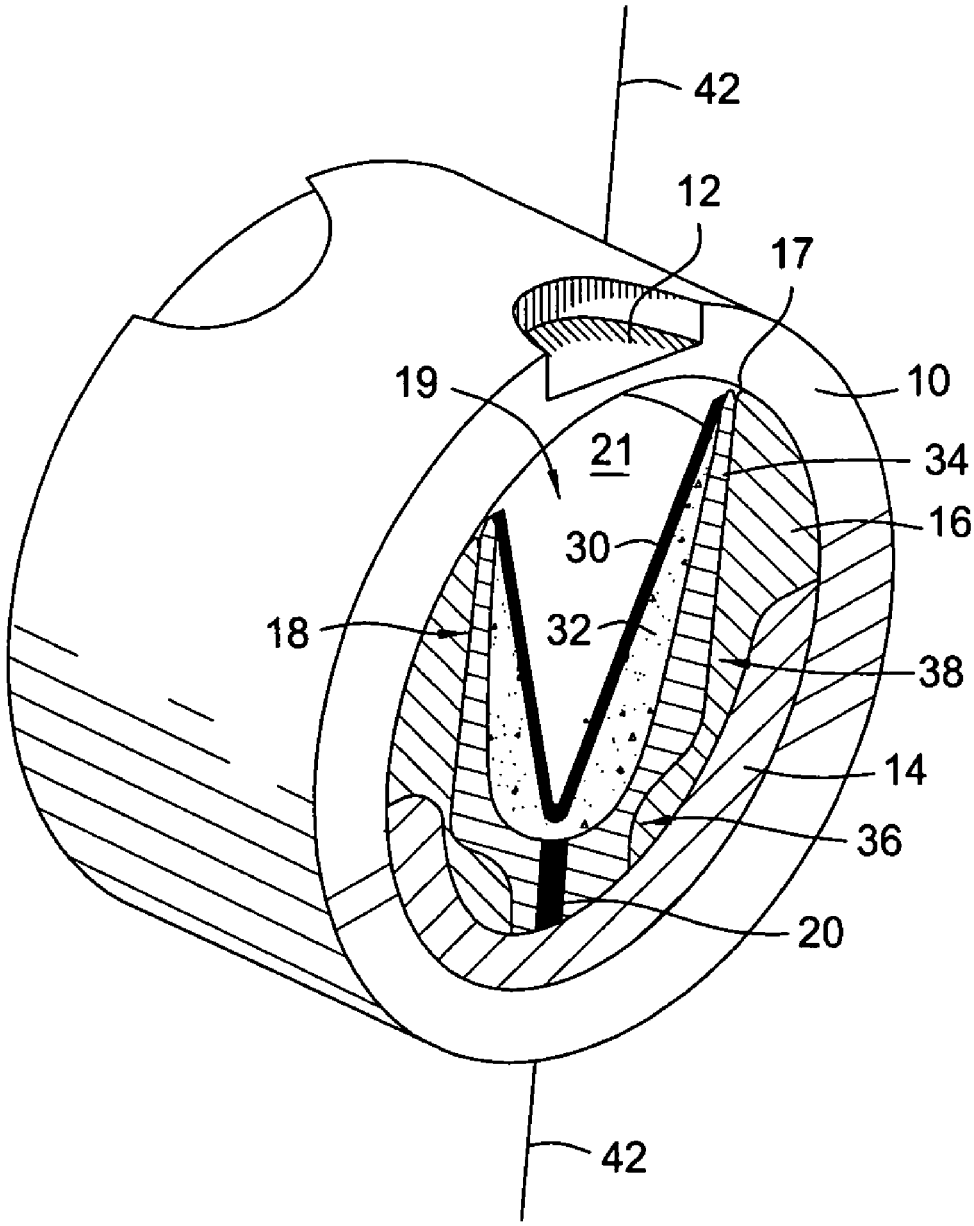
FIG. 1 depicts a perspective cross sectional view of one embodiment of a charge carrier.

With reference to the drawings herein, FIG. 1 depicts a cross sectional view of one embodiment of the present invention in a perspective aspect. As shown, this embodiment comprises a gun housing 10, a shaped charge 18, a charge carrier 16, and an optional orienting weight 14. As is known, strategic placement of the orienting weight 14 in combination with positioning the shaped charges 18 in a predetermined arrangement, can orient the perforating system 6 within the wellbore thereby creating desired perforations within the wellbore. In the embodiment of FIG. 1, the gun housing 10 shown is an elongated member having a substantially cylindrical cross section. For the purposes of the disclosure herein, the gun housing 10 can include both a gun body or a gun tube, or any other structure capable of holding, housing, and/or positioning shaped charges 18 therein. However the shape of the gun housing 10 is not limited to cylindrical cross sections, but can include other shapes, such as ones having multifaceted planar sides as hexagons, octagons, and the like. Alternatively, a gun tube (not shown) may be included with the shaped charge assembly and housed coaxially within the inner radius of the gun housing 10.

As shown, the shaped charge 18 is housed within the inner radius of the gun housing 10 and oriented perpendicular to the length of the gun housing 10. The shaped charge 18 comprises a charge casing 34, explosive 32, and a liner 30. The device disclosed herein can be used with any type of shaped charge 18, either "off-the-shelf" or manufactured to specific size, shape, or performance specifications. The charge casing 34 is comprised of a base section 36 and walls 38. The walls 38 form a generally tube-like section extending up and away from the outer circumference of the base section 36. The space between the walls 38 and the base section 36 is formed to receive the explosive 32 and the liner 30. Preferably the base section 36 has a bowl-shaped inner periphery such that its inner and outer surfaces curve parallel to the axis 42 of the base section 36 as the surfaces travel away from the axis 42. The walls 38 and the base section 36 meet approximately at the point where the inner surface of the charge casing 34 is substantially parallel to the axis 42. The base section 36 further includes a booster charge 20 for initiation of the explosive 32 within the charge casing 34.

The shaped charge 18 of FIG. 1 is oriented within the gun housing 10 such that the open end 19 of the charge casing 34 points to the optional scallop 12 that is formed on the outer surface of the gun housing 10. As is known, the presence of the scallop 12 reduces the amount of gun housing material that the detonating charge must penetrate, thereby enhancing the performance of the shaped charge perforation penetration.

The charge carrier 16 of the embodiment of FIG. 1 occupies at least a portion of the space between the inner surface of the gun housing 10 and the charge casing 34. Also, the charge carrier 16 substantially circumscribes the outer surface of the charge casing 34 at its base and along its length, but the charge carrier does not extend into the region above the open end 19 of the shaped charge. A gap 21 exists between the open end 19 of the shaped charge 18 and the inner radius of the gun housing 10 to enable formation of the shaped charge jet as it exits the shaped charge 18. Additionally, in the embodiments that do not include an orienting weight 14, the charge carrier 16 could occupy the space where the orienting weight 14 resides.

The free volume of the embodiment of FIG. 1, i.e. the volume within the inner circumference of the gun housing 10 not occupied by the shaped charge 18, charge carrier 16, or orienting weight 14, can range from about 20% to about 80% of the total empty volume of the gun housing inner space. The free volume of the perforating system 6 can be occupied by ambient air, pressurized air, or some other gas at ambient or pressurized conditions. The substance that occupies the free space is not limited to gases, but can include other low-density matter. The solid volume, i.e. the total volume of the charge carrier 16 and shaped charge 18 (and optionally the orienting weight 14), can occupy the remaining space within the gun housing 10, and thus can range from about 80% to about 20% of the total empty volume of the gun housing inner space.

In one embodiment of the present device, the free space volume occupies around 35% of the total empty volume of the gun housing inner space. This embodiment thus provides for a volume of the charge carrier 16 and shaped charge 18 (and optionally the orienting weight 14) to be around 65% of the total empty volume of the gun housing inner space. These volume ratios of free space/solid volume are not dependent upon the number of shaped charges 18 within the charge carrier 16, but are applicable to charge carriers 16 having any number of associated shaped charges 18, even those having as little as one shaped charge 18.

Figure 4A:
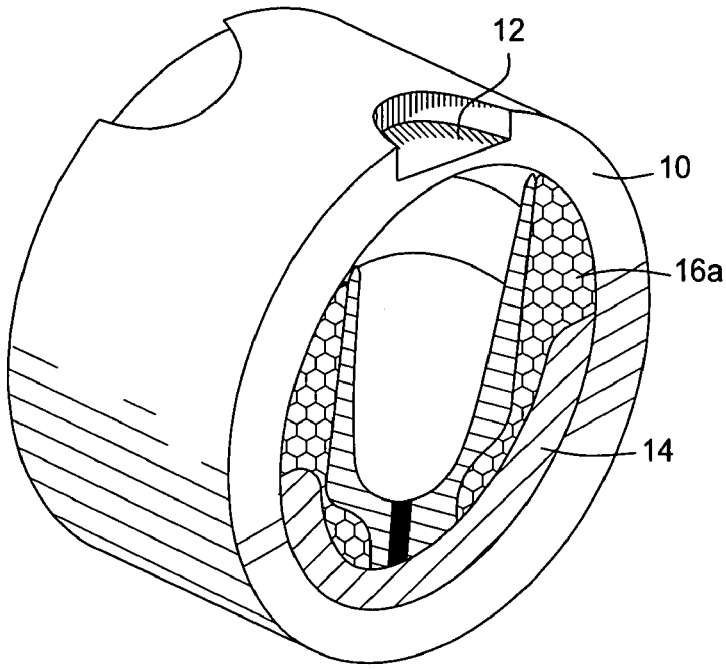
FIGS. 4*a* and 4*b* depict alternative embodiments of the structure of a charge carrier.
Figure 4B:
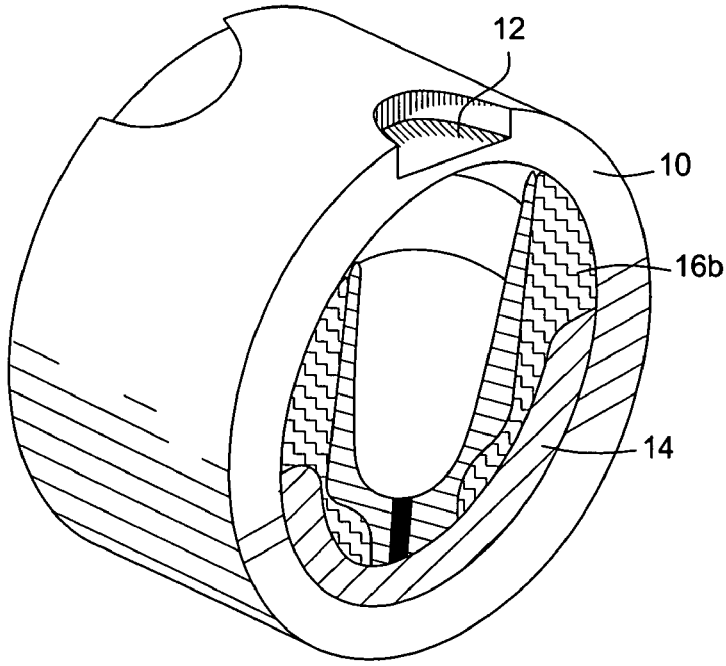

The charge carrier 16 should be capable of confining the shaped charge 18 during its detonation, thus the charge carrier material should have sufficient structural integrity to avoid being shattered or fragmented during operation. One criterion for choosing a proper material is to chose materials whose density exceeds 19 g/cc. Thus suitable materials include metals such as steel, aluminum, nickel, brass, copper, and other ductile metals to name but a few. The material selection is not limited to metals, but can also include sand, cementitious materials, water, wood, plastics, and polymeric materials. Moreover, the charge carrier 16 material need not be uniform, but can be comprised of a combination of two or more different types of materials. For example, the charge carrier 16 can be comprised of different strata of materials where the materials differ along its height. Also, high tensile bands (not shown) could be inserted within the bores 17 to provide a strengthening buffer around the shaped charges 18, while the remaining portion of the charge carrier 16 could be of a lower strength and subsequently lower density than the bands. It should be pointed out that the charge carrier 16 need not be solid but instead could have a design with multiple voids formed therein. An example might be a substrate comprised of multiple strands or weblike links structurally interconnected. More specific examples include a honeycomb structure 16*a* as shown in FIG. 4*a* and an accordion structure 16*b* as shown in FIG. 4*b*.

Figure 2:
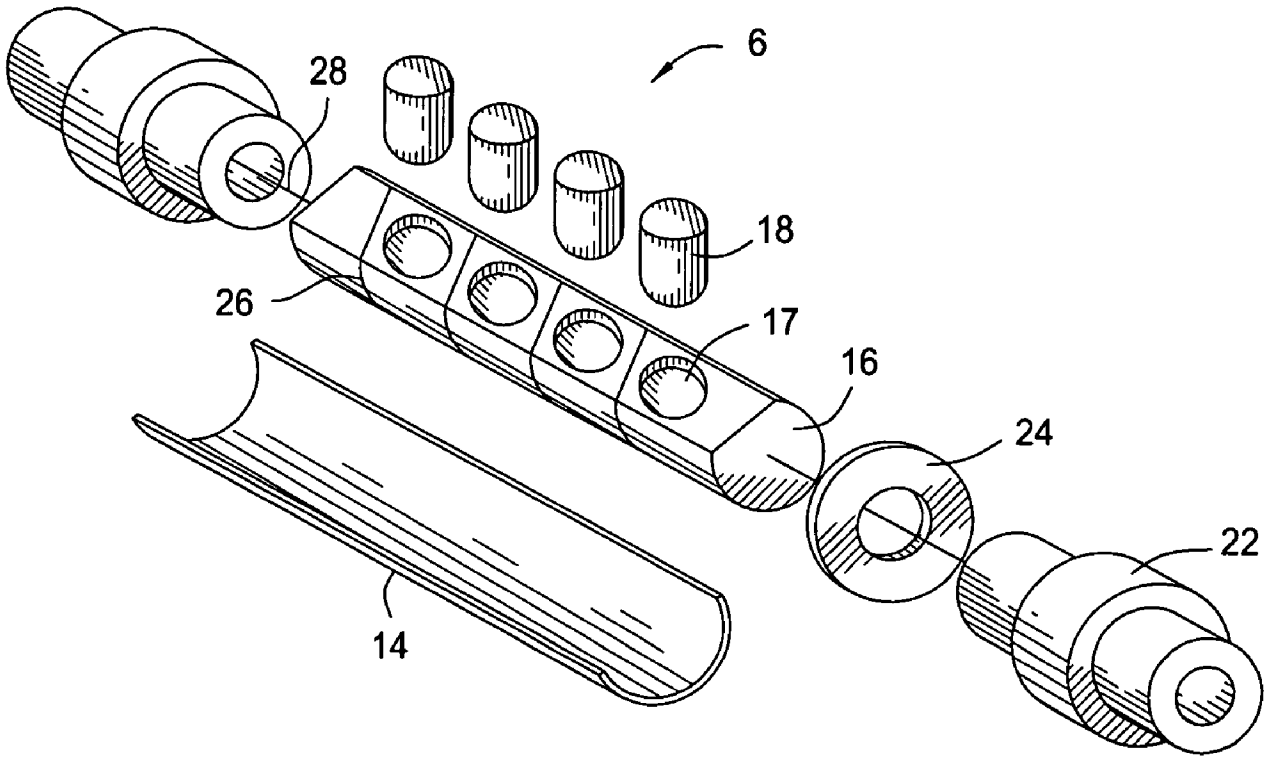
FIG. 2 illustrates a perspective view of one embodiment of the present invention.

In the embodiment depicted in FIG. 2 is shown in a perspective exploded view. In FIG. 2 the charge carrier 16 is shown having bores 17 formed therein perpendicular to the axis 28 of the charge carrier 16. The bores 17 extend through the charge carrier 16 and are profiled to match the profile of the walls 38 and base section 36 of the charge casing 34. Accordingly the bores 17 engagingly receive the shaped charges 18 within their inner periphery. While the bores 17 shown are aligned at roughly the same radial location on the charge carrier 16, the bores 17 can be formed at any radial location on the carrier 16. As with many perforating systems, the shaped charges 18 can be "phased" such that they are positioned within the perforating system 6 to detonate at multiple radial locations around the charge carrier 16. The specific shaped charge phasing is dependent on the particular application of the perforating system 6 and thus many phasing scenarios are available. Also shown in FIG. 2 included with the perforating system 6 are connectors 22 for connecting the adjacent segments of the perforating system 6. Also shown is a stop ring 24 that is used in securing the charge carrier 16 into a proper orientation so that the shaped charges 18 are aligned with their respective scallops 12.

Adjacent bores 17 must have a sufficient amount of charge carrier material between them for withstanding the detonation force of the explosive to thereby prevent fragmentation of the charge carrier 16. The distance between adjacent bores 17 depends on the type of material used in forming the charge carrier 16. A charge carrier 16 formed from materials having low yield strength will require more material between adjacent bores 17 than a carrier 16 made from a material having high yield strength. Those skilled in the art can determine the required distance with regard to each specific material used in manufacturing the charge carrier 16 without undue experimentation. Likewise, a certain amount of charge carrier 16 material must be present between the end of the charge carrier 16 and the outermost shaped charge 18 for bolstering the resiliency of the charge carrier end to prevent fragmentation during detonation of the shaped charge 18. How much material is required depends on the physical properties of the material—this also can be determined by those skilled in the art.

Impedance barriers 26 can be formed on the charge carrier 16 between each bore 17. The impedance barriers 26 are troughs cut or formed perpendicular to the axis 28 of the charge carrier 26. These troughs can simply be air filled voids existing between the bores 17, or can be filled with shock absorbing material such as cotton, rubber, polymeric compositions, plastics, cork, felt, or like materials. The existence of the impedance barriers 26 serves to eliminate shock wave interference that can be transmitted from one shaped charge 18 to an adjacent shaped charge 18.

Figure 3B:
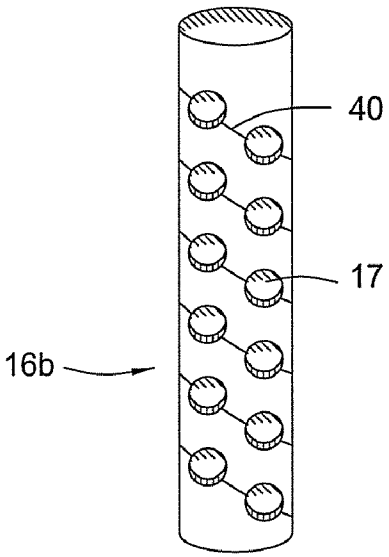
FIGS. 3*a* and 3*b* portray perspective views of embodiments of a charge carrier.
Figure 3A:
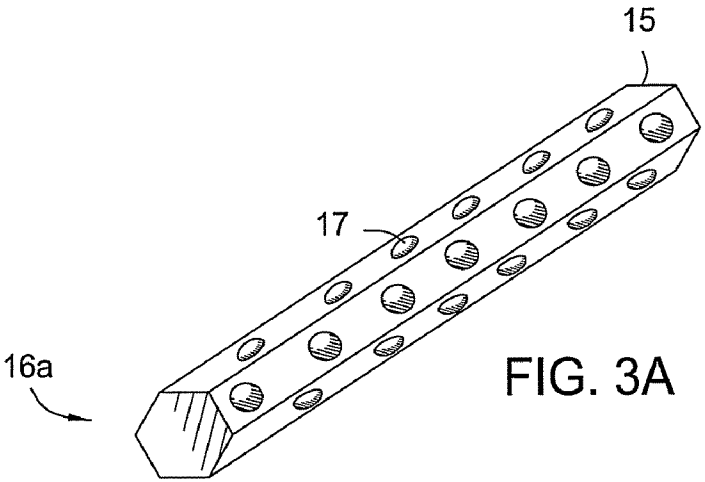

Additional embodiments of the charge carrier (16*a*, 16*b*) are illustrated in FIGS. 3*a* and 3*b*. With respect to FIG. 3*a*, the charge carrier 16*a* has a hexagonal cross section where the outer periphery is comprised of planar sides 15 connected at their respective ends. Bores 17 are formed within the sides 15, and can be placed in any pattern depending on the design requirements of the particular perforating system 6. Also, the embodiment of FIG. 3*a* is not limited to six sided members, but can include any number of planar sides 15. With regard now to the embodiment of FIG. 3*b*, here a charge carrier 16*b* is illustrated with associated bores 17 arranged in a spiral pattern along its length. Other slot patterns include a helical arrangement, multiple spirals, staggered, high density, or any other know known or later developed slot arrangement.

Figure 5:
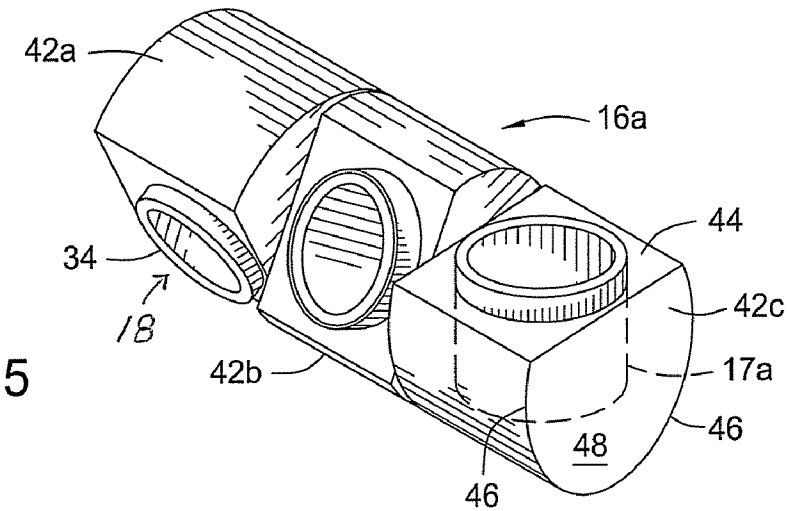
FIG. 5 illustrates a segmented embodiment of a charge carrier.

FIG. 5 illustrates one embodiment of a charge carrier 16*a* comprised of modular segments (42*a*, 42*b*, 42*c*). Here the segments (42*a*, 42*b*, 42*c*) each have a bore 17*a* (shown in a dashed outline) formed through its upper face 44. As shown, each bore 17*a* has a shaped charge 18 with charge casing 34 disposed within. The lateral sides 46 of each segment (42*a*, 42*b*, 42*c*) are curved and formed to fit inside of a gun tube or gun body. The distal sides 48 of the segments (42*a*, 42*b*, 42*c*) are generally planar. Each segment is preferably affixed to each adjacent segment either by pins (not shown), welding, or any other type of fastening means suitable for securing the segments. Although the segments (42*a*, 42*b*, 42*c*) of FIG. 5 are shown in a phased configuration, the segments (42*a*, 42*b*, 42*c*) can be aligned such that their respective shaped charges 18 could be fired in a straight line. It should be pointed out that the volume values discussed above are applicable to each individual segment, or the segments as a whole. For example, the combined volume of the segment 42*a* and its corresponding shaped charge 18 can range from about 80% to about 20% of the total empty volume of the inner space of the portion of the gun housing occupied by the segment 42*a*. Accordingly the free volume that occupies the space between the segment 42*a* and its corresponding shaped charge 18 thus ranges from about 20% to about 80% of the total empty volume of the inner space of the portion of the gun housing occupied by the segment 42*a*. Similarly, the combined volume of all segments (42*a*, 42*b*, 42*c*) and their respective shaped charges 18 can occupy from about 80% to about 20% of the total empty volume of the inner space of the portion of the gun housing occupied by these segments (42*a*, 42*b*, 42*c*). Thus resulting in a free volume between the segments (42*a*, 42*b*, 42*c*) and their corresponding shaped charges 18 to range from about 20% to about 80% of the total empty volume of the inner space of the portion of the gun housing occupied by the segment 42*a*. Moreover, the embodiment of FIG. 5 includes a solid volume to free volume ratio of 65% to 35%, for individual segments and when combined as a whole.

While detonation of the shaped charges 18 of the perforating system 6 disclosed herein results in some damage to the component parts, the fragmented parts are contained within the gun housing 10. Accordingly when the perforating system 6 is retrieved from the wellbore after use, either no debris, or a negligible amount of debris, remains within the borehole. Thus use of the present device substantially reduces the threat of clogging due to fractured component per.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the invention described herein is applicable to any shaped charge phasing as well as any density of shaped charge. Moreover, the invention can be utilized with any size of perforating gun. These and other similar modifications will readily suggest themselves to those skilled in the art, and are intended to be encompassed within the spirit of the present invention disclosed herein and the scope of the appended claims.

What is claimed is:

1. A perforating gun comprising:

an annular gun housing;

a solid metal elongated charge carrier inserted into the gun housing, bores provided in an upper surface of the charge carrier, and a lateral surface on the charge carrier extending between opposing lateral sides of the upper surface, so that when the charge carrier is inserted into the gun housing substantially all of the lateral surface is in contact with the gun housing; and shaped charges within the bores, each shaped charge having an open end, explosive in the open end, and a closed end, so that when the shaped charges are initiated, the configuration and composition of the charge carrier maintains the structural integrity of the shaped charge upon detonation of the explosive.

2. The perforating gun of claim 1, wherein the charge carrier material density is at least about 19 g/cc.

3. The perforating gun of claim 2, wherein said charge carrier is comprised of a substantially non-frangible substrate comprised of weblike links structurally interconnected.

4. The perforating gun of claim 1, wherein the combined volume of the charge carrier and the shaped charge is about 65% of the total empty volume of the gun housing inner space and wherein the free volume within the gun housing is about 35% of the total empty volume of the gun housing inner space.

5. The perforating gun of claim 1 further comprising a gap in the region between the open end of the shaped charge and the gun housing.

6. The perforating gun of claim 1 further comprising a multiplicity of bores in the charge carrier with shaped charges therein.

7. The perforating gun of claim 6, wherein the bores are arranged perpendicular to the axis of the charge carrier, and each of said bores are disposed at substantially the same radial location about the axis of the charge carrier.

8. The perforating gun of claim 6, wherein each of said bores are arranged perpendicular to the axis of the charge carrier, and each of said bores are spaced about the axis of the charge carrier at multiple radial locations.

9. The perforating gun of claim 6, wherein said bores form a spiral pattern along the outer surface of said charge carrier.

10. The perforating gun of claim 6, wherein each of said multiplicity of shaped charges has an open end and wherein said shaped charge assembly further comprises a gap in the region between each of said open ends and the gun housing.

11. The perforating gun of claim 10, further comprising explosive within each shaped charge, wherein said charge carrier maintains the structural integrity of each shaped charge upon detonation of the explosives.

12. The perforating gun of claim 1, wherein said charge carrier comprises at least two modular segments.

13. A perforating gun comprising:

a gun housing;

a shaped charge housed within the gun housing, said shaped charge comprising a casing, a liner within the casing, and explosive between the casing and the liner, the casing having a base section and walls extending from the base section; and a first charge carrier inserted into the gun housing, a bore provided in an upper surface of the first charge carrier, and a lateral surface on the first charge carrier extending between opposing lateral sides of the upper surface of the first charge carrier, so that when the charge carrier is inserted into the gun housing substantially all of the lateral surface is in contact with the gun housing;

a second charge carrier inserted into the gun housing having an upper surface that is disposed in a plane at an angle with respect to the upper surface of the first charge carrier, a bore provided in the upper surface of the second charge carrier, and a lateral surface on the second charge carrier extending between opposing lateral sides of the upper surface of the second charge carrier, so that when the charge carrier is inserted into the gun housing substantially all of the lateral surface of the second charge carrier is in contact with the gun housing;

a shaped charge within the bore in the first charge carrier and the bore in the second charge carrier, each shaped charge having an open end, explosive, and a closed end, so that when the shaped charges are initiated, the configuration and composition of the first and second charge carriers maintain the structural integrity of the shaped charges upon detonation of the explosive.

14. The perforating gun of claim 13, wherein the charge carrier material density is at least about 19 g/cc.

15. The perforating gun of claim 14, wherein said charge carrier is comprised of a substrate comprised of weblike links structurally interconnected.

16. The perforating gun of claim 13, wherein the combined volume of the charge carrier and the shaped charge is about 65% of the total empty volume of the gun housing inner space and wherein the free volume within the gun housing is about 35% of the total empty volume of the gun housing inner space.

17. The perforating gun of claim 13, wherein the first and second charge carriers each have planar sides that are in contact.

18. The perforating gun of claim 13, wherein said charge carrier comprises at least two modular segments.

19. A method of perforating a wellbore comprising:

providing an annular perforating gun housing;

providing shaped charges each having a charge case with an open end and sides, a liner inserted into the open end, and explosive between the liner and charge case;

providing an elongated solid metal charge carrier having an upper surface along the length of the charge carrier defining lateral edges on opposing sides of the upper surface and a lower surface extending between the lateral edges that is profiled so that when the charge carrier is inserted into the gun housing, a substantial portion of the lower surface is in contact with the gun housing and a gap is between the upper surface and the gun housing;

forming bores in the upper surface of the charge carrier that are set apart a sufficient distance so that enough charge carrier material is between adjacent bores that prevents charge carrier fragmentation when the shaped charges are detonated within the bores;

disposing the shaped charges in the bore so that the charge carrier contactingly circumscribes sides of the shaped charges;

inserting the charge carrier with shaped charges into the gun housing;

disposing the gun housing with charge carrier and shaped charges into a wellbore;

detonating the shaped charges, and maintaining the structural integrity of the shaped charges upon detonation of the explosive by the configuration and composition of the charge carrier; and removing the gun housing from the wellbore thereby also removing from the wellbore the charge carrier and substantially all of each charge casing.

20. The method of claim 19, further comprising determining the amount of material required between adjacent bores so that the shaped charge detonation does not fragment the charge carrier.

* * * * *